United States Patent [19]

Hirose et al.

[11] 3,984,245

[45] Oct. 5, 1976

[54] PHOTOGRAPHIC SENSITIVE MATERIALS

[75] Inventors: Takeshi Hirose; Keisuke Shiba, both of Minami-ashigara, Japan

[73] Assignee: Fuji Photo Film Co., Ltd., Minami-ashigara, Japan

[22] Filed: Oct. 9, 1974

[21] Appl. No.: 513,670

[30] Foreign Application Priority Data

Oct. 9, 1973 Japan ..... 48-113633

[52] U.S. Cl. ..... 96/74; 96/100

[51] Int. Cl.[2] ..... G03C 1/76

[58] Field of Search ..... 96/56, 100, 84 R, 84 A, 96/74

[56] References Cited

UNITED STATES PATENTS

| | | | |
|---|---|---|---|
| 3,227,550 | 1/1966 | Whitmore et al. | 96/100 X |
| 3,227,551 | 1/1966 | Barr et al. | 96/100 X |
| 3,227,552 | 1/1966 | Whitmore | 96/100 |
| 3,227,554 | 1/1966 | Barr et al. | 96/74 X |
| 3,271,147 | 9/1966 | Bush | 96/100 X |
| 3,271,148 | 9/1966 | Whitmore | 96/100 X |
| 3,282,699 | 11/1966 | Jones et al. | 96/84 R |
| 3,364,022 | 1/1968 | Barr | 96/100 X |
| 3,632,373 | 1/1972 | O'Connell et al. | 96/74 X |
| 3,723,125 | 3/1973 | Hatashi et al. | 96/74 X |

*Primary Examiner*—David A. Simmons
*Attorney, Agent, or Firm*—Sughrue, Rothwell, Mion, Zinn and Macpeak

[57] ABSTRACT

A photographic photosensitive material comprising a support having thereon at least one photosensitive silver halide emulsion layer, at least one photosensitive silver halide emulsion layer containing a compound which releases an organic development inhibitor on development, and a colloid layer containing a basic synthetic polymer containing therein the repeating unit represented by the formula (I)

(I)

wherein $R_1$ represents a hydrogen atom or an alkyl group having 1 to 6 carbon atoms; $R_2$ represents a hydrogen atom, an alkyl group having 1 to 6 carbon atoms or an aryl group; *m* is 1 or 2; *n* is 1 or 2; *q* is 1 or 2; and $A_1$ represents a group containing a nitrogen atom which forms a secondary amino group, a tertiary amino group or a quaternary ammonium group, and $A_1$ may combine with $R_2$; or the formula (II)

(II)

wherein $A_2$ represents a hydrogen atom or a substituted or unsubstituted alkyl group; $A_3$ represents a hydrogen atom or a substituted or unsubstituted alkyl group; X represents an anion; and *d* is 1 or 2.

20 Claims, 5 Drawing Figures

PHOTOGRAPHIC SENSITIVE MATERIALS

BACKGROUND OF THE INVENTION

1. Field of the Invention

The present invention relates to photographic sensitive materials and particularly to photographic sensitive materials having an emulsion layer containing a compound which releases an organic development inhibitor out of the layer by development wherein the photographic sensitive materials comprise a colloid layer which absorbs a part or all of the released organic development inhibitor.

2. Description of the Prior Art

Many kinds of compounds which release an organic development inhibitor are already known, and they are added to photographic emulsion layers for various purposes. Such compounds are hydroquinone derivatives having a substituted monothio group as described in U.S. Pat. Nos. 3,379,529 and 3,639,417 and U.S. patent application Ser. No. 494,955, filed on Aug. 5, 1974. These compounds are used, for example, for the purpose of improving the graininess and sharpness of photographic images. They are also used for the purpose of improving color reproduction of multilayer color photographic materials as described in U.S. patent application Ser. No. 461,087, filed Apr. 15, 1974. Further, they are used for image reversal in a dye diffusion transfer photographic process as described in U.S. Pat. No. 3,364,022. Furthermore, they are used for the purpose of eliminating images in adjacent layers in photographic sensitive materials for double-image photographing as described in U.S. Pat. No. 3,620,746. Moreover, they are used as a silver image forming material as described in U.S. Pat. Nos. 3,705,801 and 3,737,312.

Other examples of such compounds include couplers having a triazole or diazole group which is substituted at a coupling position as described in U.S. patent application Ser. No. 454,525, filed on Mar. 25, 1974. These couplers are used for color correction in multilayer color photosensitive materials.

Additional examples of such compounds include couplers having a monothio group or selenazole group which is substituted at a coupling position as described in U.S. Pat. Nos. 3,701,783, 3,733,201 and 3,632,345. Such compounds are used for the purpose of improving the graininess and sharpness of photographic images as described in U.S. Pat. No. 3,227,554. They are also used for the purpose of preventing fogging as described in U.S. Pat. No. 3,703,375. Further, they are used for image reversal in a dye diffusion transfer photographic process as described in U.S. Pat. Nos. 3,227,551 and 3,736,136. Furthermore, they are used for the purpose of producing color photographic sensitive materials in a stable manner as described in U.S. Pat. No. 3,632,373. Moreover, they are used for the purpose of eliminating images of adjacent layers in photographic sensitive materials for double-image photographing as described in U.S. Pat. No. 3,620,746. In addition, they are used for the purpose of expanding the tolerance of exposure of photographic sensitive materials as described in U.S. Pat. Nos. 3,620,474 and 3,615,499.

Further examples of such compounds include organic heterocyclic compounds having an oxo or thioxo group as described in U.S. Pat. Nos. 3,713,828 and 3,723,125, and compounds having a mercapto group or a thioether bond as described in U.S. Pat. No. 3,536,487 and U.S. Defensive Publications Nos. T909,022 and T909,023. These compounds are used for the purpose of strengthening the under-cut interimage effect and improving color reproduction in multilayer color photosensitive materials.

When the above described compounds which release an organic development inhibitor by development are used in emulsion layers of photographic sensitive materials, serious defects result. Namely, the organic development inhibitor released by development not only diffuses out of the emulsion layer and causes the inhibition of the development of other emulsion layers in the case of a multilayer photosensitive material — the so-called under-cut interimage effect, but also the released inhibitor leaches into the developer to inhibit the development in an unnecessarily wide range. The so-called under-cut interimage effect can be advantageously utilized for image reversal or improvement of color reproduction of multilayer color photosensitive materials. However, its effect and range should be limited to a definite emulsion layer and it is necessary to prevent undesired influences upon other layers. Further, in using these compounds for the purpose of improving color reproduction, it is sometimes necessary to obtain an optimum effect by adjusting the degree of the under-cut interimage effect. Further, the movement of the organic development inhibitor into the developer induces the generation of development mottle deteriorating the finished image quality. Accordingly, it becomes necessary to prevent movement of the organic development inhibitor into the developer from the photosensitive materials.

SUMMARY OF THE INVENTION

One object of the present invention is to improve the above described defects appearing in photographic sensitive materials using a compound which releases an organic development inhibitor by development.

One method of solving this problem is a method which comprises providing an adsorbing colloid layer containing silver halide particles. However, using this method, the desired object has not always been attained sufficiently. Further, if the silver halide particles are used in a large amount in order to achieve a sufficient effect, a deterioration of sensitivity results due to the decrease in light transmittance or a retardation of development results due to an interruption of the diffusion of the developing agent. Further, the surface of the photosensitive material is damaged by the formation of silver scum by interaction with the developer.

A further object of the present invention is to provide a method for absorbing the released organic development inhibitor while removing the defects caused by silver halide particles used for adsorbing the released organic inhibitor.

These and other object of the present invention will be clear from the following descriptions and examples.

These objects of the invention have been attained with a photographic sensitive material comprising a support having thereon at least one photosensitive silver halide emulsion layer, at least one of the silver halide emulsion layers containing a compound which releases an organic development inhibitor on development, and having a colloid layer containing a basic synthetic polymer having therein a repeating unit represented by the following formula (I)

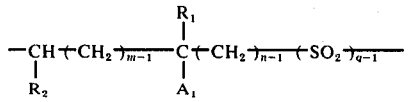

(I)

wherein $R_1$ represents a hydrogen atom or an alkyl group having 1 to 6 carbon atoms; $R_2$ represents a hydrogen atom, an alkyl group having 1 to 6 carbon atoms or an aryl group; *m* is 1 or 2; *n* is 1 or 2; *q* is 1 or 2; $A_1$ represents a group which contains a nitrogen atom forming a secondary amino group, tertiary amino group or quaternary ammonium group; and $A_1$ and $R_2$ can combine to form a ring; or the following formula (II)

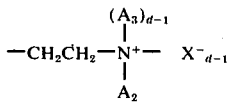

(II)

wherein $A_2$ represents a hydrogen atom or a substituted or unsubstituted alkyl group; $A_3$ represents a hydrogen atom or substituted or unsubstituted alkyl group; X represents an anion; and *d* is 1 or 2.

DETAILED DESCRIPTION OF THE INVENTION

Figure 1:
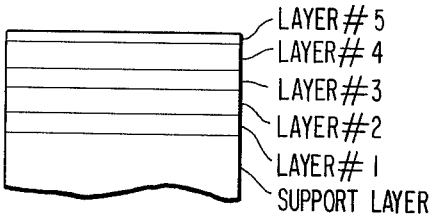
FIGS. 1, 2 and 3 each shows an embodiment of the layer structure of samples used in the Examples.

According to one preferred embodiment of the present invention, the photographic sensitive materials comprise a support having silver halide emulsion layer containing a compound which releases an organic inhibitor by development and a colloid layer (ADL) containing a basic synthetic polymer containing the repeating unit represented by the above formula (I) or (II) on this silver halide emulsion layer or between the support and this silver halide emulsion layer.

As described above the basic synthetic polymer which can be used includes polymers having a recurring unit represented by the following formula (I)

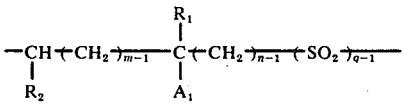

(I)

wherein $R_1$ represents a hydrogen atom or an alkyl group having 1 to 6 carbon atoms such as methyl, ethyl, etc.; $R_2$ represents a hydrogen atom, an alkyl group having 1 to 6 carbon atoms such as methyl, ethyl, etc. or an aryl group such as phenyl, tolyl, etc.; *m* represents 1 or 2; and $A_1$ represents a group having a nitrogen atom which forms a secondary amino group, a tertiary amino group or a quaternary ammonium group; and $A_1$ and $R_2$ can combine to form a ring; or the formula (II)

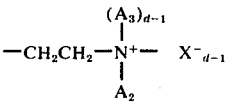

(II)

wherein $A_2$ represents a hydrogen atom or a substituted or unsubstituted alkyl group having 1 to 6 carbon atoms) such as methyl, ethyl, etc.); X represents a salt-forming anion; and *d* represents 1 or 2.

Preferred groups represented by $A_1$ in the formula (I) are groups represented by the following formula (Ia)

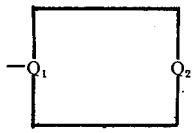

(Ia)

wherein $Q_1$ represents a carbon atom or a nitrogen atom; and $Q_2$ represents the non-metal atoms to form, together with $Q_1$, a 5-membered or a 6-membered heterocyclic ring containing a nitrogen atom which forms a secondary amino group, a tertiary amino group or a quaternary ammonium group; or the formula (Ib)

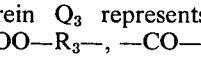

(Ib)

wherein $Q_3$ represents —O—$R_3$—, —OCO—$R_3$—, —COO—$R_3$—, —CO—$R_3$—,

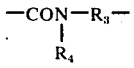

or an arylene group (such as phenylene, etc.); $Q_4$ represents

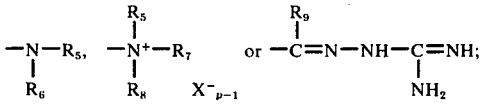

*l* represents 1 or 2; $R_3$ represents an alkylene group (e.g., having 1 to 6 carbon atoms) or an arylene group (such as phenylene, etc.); $R_4$ represents a hydrogen atom, an alkyl group (e.g., having 1 to 6 carbon atoms, such as methyl, ethyl, etc.), an aryl group (such as phenyl, etc.), or an alkylene group (e.g., having 1 to 6 carbon atoms) connected to $Q_4$; $R_4$ represents an alkyl group (e.g., having 1 to 6 carbon atoms such as methyl, ethyl, butyl, etc.), an aryl group (e.g., such as phenyl) or an aralkyl group (e.g., such as benzyl), $R_6$ represents a hydrogen atom, an alkyl group (e.g., having 1 to 6 carbon atoms such as methyl, ethyl, butyl, etc.), an aryl group (e.g., such as phenyl) or an aralkyl group (e.g., such as benzyl); and $R_6$ and $R_4$ can combine to form a ring; $R_7$ represents a hydrogen atom, an alkyl group (e.g., having 1 to 6 carbon atoms such as methyl, ethyl, butyl, etc.), an aryl group (e.g., such as phenyl) or an aralkyl group (e.g., such as benzyl); $R_8$ represents a hydrogen atom, an alkyl group, (e.g., having 1 to 6 carbon atoms such as methyl, ethyl, butyl, etc.), an aryl group (e.g., such as phenyl), an aralkyl group (e.g., such as benzyl), a carboxyalkyl group (e.g., having 1 to 6 carbon atoms) or a sulfoalkyl group (e.g., having 1 to 6 carbon atoms); $R_9$ represents an alkyl group (e.g., having 1 to 6 carbon atoms); $R_9$ represents an alkyl group (e.g., having 1 to 6 carbon atoms such as methyl, ethyl, butyl, etc.); X represents a salt-forming anion; and *p* represents 1 or 2.

When $A_1$ and $R_2$ combine with $Q_3$ or $Q_4$ in the formula (Ib) or when $R_4$ and $R_6$ combine in the formula (Ib), such group can be a group represented by the following general formulas

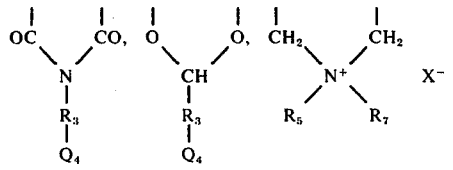

wherein $R_3$, $R_5$, $R_7$, $Q_4$ and X each has the same meaning as defined above.

The non-metal atoms represented by $Q_2$ in the formula (Ia) can be selected from a carbon atom, an oxygen atom, a sulfur atom, a selenium atom and a nitrogen atom. Further, the moiety represented by $Q_2$ can be substituted with a substituted or unsubstituted alkyl group (e.g., having 1 to 6 carbon atoms), a substituted or unsubstituted aryl group (e.g., phenyl) or a fused ring. Preferred examples of heterocyclic rings are pyridine, imidazole, pyrozine, pyrrole and the like.

A polymer containing a recurring unit represented by the following formula (III)

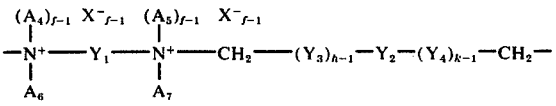

(III)

wherein $A_4$, $A_5$, $A_6$ and $A_7$ each represents a lower alkyl group (e.g., having 1 to 6 carbon atoms) or $A_4$ and $A_5$ and/or $A_6$ and $A_7$ can combine to form a nitrogen containing heterocyclic ring (s); $Y_1$ and $Y_2$ each represents an alkylene group, a phenylene group, a xylylene group or a cyclohexylene group, and the alkylene group can contain a double bond, a triple bond, $—SO_2—$ or —O— in the chain thereof; $Y_3$ and $Y_4$ each represents —COO— or

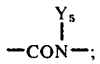

$Y_5$ represents a hydrogen atom or an alkyl group (e.g., having 1 to 6 carbon atoms); X represents a salt-forming anion; and *f*, *h* and *k* each represents 1 or 2.

The anion represented by X in the above-described formulas (I), (II) and (III) includes a mono-valent anion which can form a conventional quaternary salt, such as a halogen ion such as a chlorine ion, a perchlorate ion, an acetate ion, a sulfonate ion such as a p-toluene sulfonate ion, a monoalkylsulfate ion, dialkylphosphate ion and the like.

A basic polymer of particular use is the polymer represented by the formula (I) wherein $R_1$ represents a hydrogen atom or a methyl group; $R_2$ represents a hydrogen atom; *m*, *n* and *q* each represents 1; $A_1$ represents a pyridine or imidazole structure or $—COO—R_3—Q_4$, $—CO—R_3—Q_4$ or $—CONH—R_3—Q_4$; wherein $R_3$ and $Q_4$ each has the same meaning as defined above.

Examples of basic polymers used in the present invention and processes for their synthesis are described in, for example, British Pat. Nos. 786,592, 906,083, 1,034,044, 1,151,877, 1,161,131, 1,162,214 and 1,261,925, U.S. Pat. Nos. 3,282,699, 3,408,193 and 3,445,231, German Patent Publications (OLS) Nos. 1,803,634, 1,914,361 and 1,914,362, and Japanese Patent Publication No. 10254/1968.

Typical examples of the repeating unit which comprises the basic synthetic polymers used in the present invention are described in the following (A) 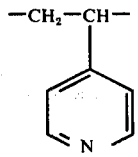

(B) 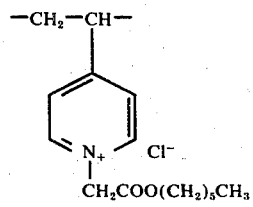

(C) 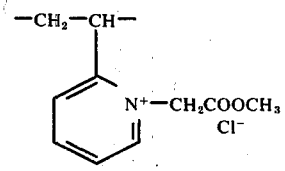

-continued
(D) 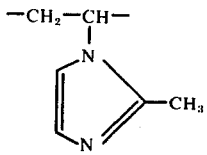
(E) 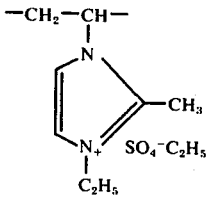
(F) 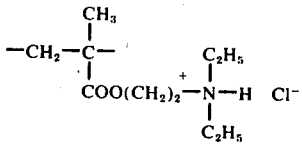
(G) 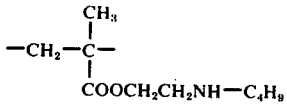
(H) 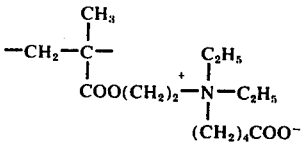
(I) 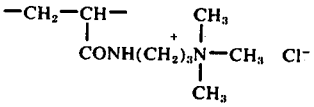
(J) 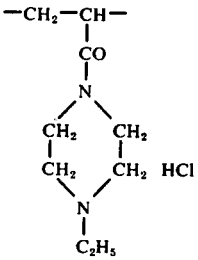
(K) 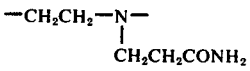
(L) 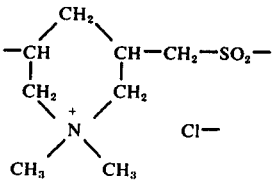
(M) 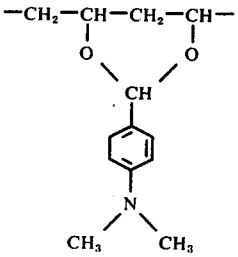

-continued
(N)
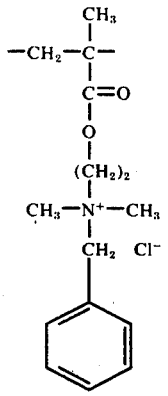
(O)
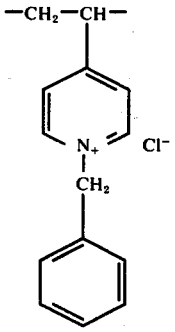
(P)
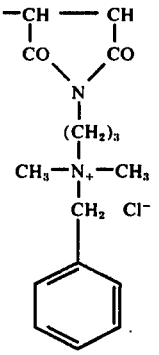
(Q)
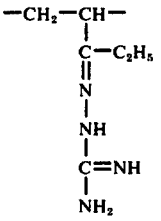
(R)
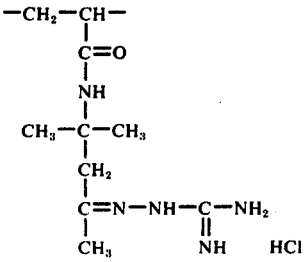

-continued (S) 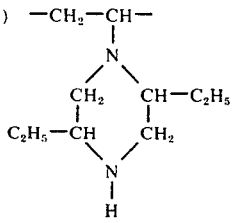

(T) 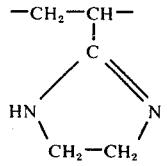

(U) 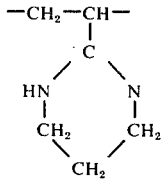

(V) 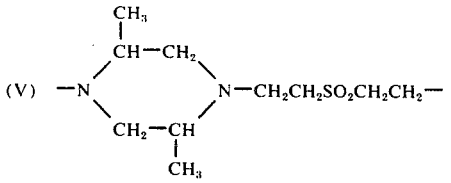

(W) 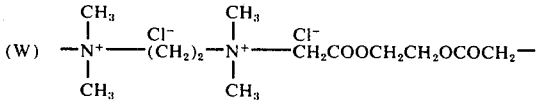

(X) 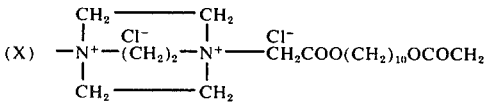

(Y) 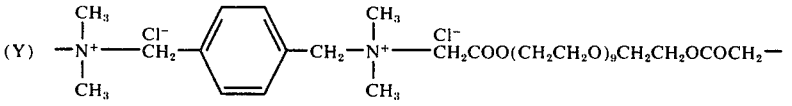

(Z) 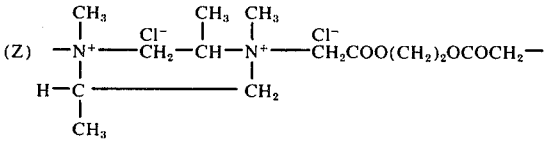

It is preferred that about 20 mol% or more of the repeating units in the basic polymers used in the present invention be composed of the above described repeating unit containing a nitrogen atom which forms a secondary amino, tertiary amino or quaternary ammonium group. Particularly, those compounds containing above 50 mol% of such repeating unit are preferred. Examples of monomer units which can form polymers together with these basic monomer units include methyl acrylate, ethyl acrylate, hydroxyethyl acrylate, butyl acrylate, methyl methacrylate, ethyl methacrylate, hydroxyethyl methacrylate, acrylamide, methacrylamide, N-methyl acrylamide, methylol acrylamide, N,N-diethyl acrylamide, N-vinylpyrrolidone, N-vinyloxazolidone, N-vinylcaprolactam, N-vinyl-N-methylacetamide, acrylonitrile, vinyl acetate, vinyl propionate, styrene, methylstyrene, methyl vinyl ketone, maleic acid anhydride, methyl vinyl ether, butadiene, isoprene and chlorprene, etc.

In the ADL of the present invention, two or more basic synthetic polymers represented by the formula (I) or (II) can be used together in an amount of about 0.001 to about 10 g/m$^2$, preferably 0.01 to 1 g/m$^2$ of the support. Further, it is possible to further improve the function of adsorbing the organic development inhibitor by using the silver halide particles as described in U.S. patent application Ser. No. 484,742, filed July 1, 1974, colloidal silver, colloidal gold or colloidal silica together with the polymers. Such a colloidal material can be used in an amount of about 0.001 to about 20 g/m$^2$, preferably 0.01 to 5 g/m$^2$ of the support. A suitable particle size of the colloidal material ranges from about 0.01 to 1 $\mu$, preferably 0.01 to 0.5 $\mu$. It is also possible to provide the functions of antiirradition, antihalation and a light filter, to improve safe-light stabilization, or to control printing conditions for positive sensitive materials by using the acid dyes described in U.S. patent application Ser. No. 501,107, filed on Aug. 27, 1974.*

*(Japanese Japanese Patent Application No. 96965/73)

An acid dye which can be used in the present invention is a water soluble dye containing an anionic water-solubilizing group such as a sulfo group, a carboxylic acid group, a phosphoric acid group, a sulfuric acid group, particularly a sulfo group. As such a dye, an oxonol dye, a triphenylmethane dye, an anthraquinone dye, a benzoquinone dye, an azo dye and an organo-metal complex dye, particularly a dye in which an anionic water-solubilizing group is introduced into the dye skeleton which is known as a sensitizing dye such as those described in F. M. Hamer, *The Cyanine Dyes and Related Compounds*, Interscience Publishers (1964), are useful. For example, a cyanine dye, a merocyanine dye, a complex merocyanine dye, a hemicyanine dye and the like are illustrated. In greater detail, the dyes described in U.S. Pat. Nos. 3,260,601; 3,282,699; 3,294,539; 3,316,091; 3,352,680; 3,379,533; 3,382,074; 3,384,487; 3,389,994; 3,406,069; 3,409,433; 3,417,084; 3,423,207; 2,440,051; 3,468,883; 3,471,293; 3,480,436; 3,485,632; 3,481,927; 3,486,897; 3,493,375; 3,497,502; 3,531,287; 3,540,887; 3,540,888; 3,563,748; 3,560,214; 3,547,640; 3,573,289; 3,576,640; 3,615,546 and 3,615,432; Japanese Patent Pulications Nos. 18459/66; 35041/68; 13168/68; 13498/68 and 21766/68; and British Patent Nos. 1,025,567; 1,027,747; 1,030,392; 1,034,044; 1,091,366; 1,112,035; 1,167,026; 1,177,429 and 1,241,692, etc. are useful.

Specific examples of dyes are shown below.

(1)

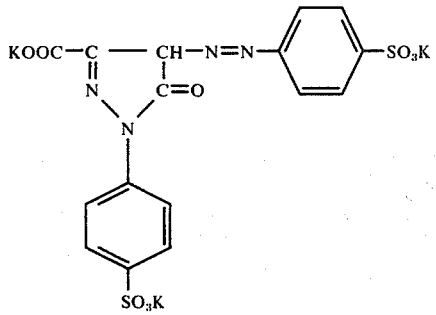

(2)

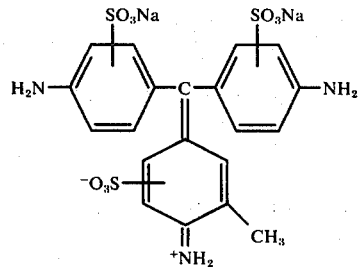

(3)

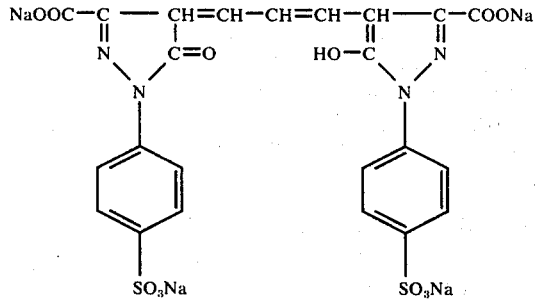

(4)

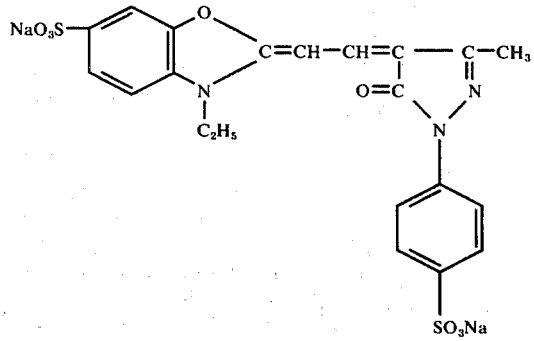

-continued (5)

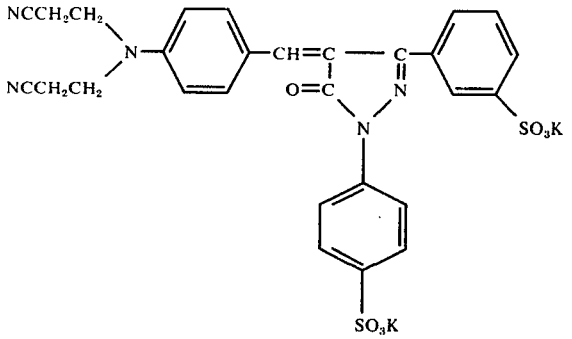

The ADL of the present invention can be advantageously used for all photosensitive materials containing a compound which releases an organic development

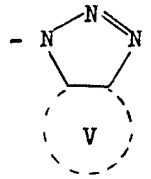

inhibitor. Particularly preferred results can be obtained if the ADL is used for multilayer color photosensitive materials containing an interlayer color correction coupler, an interlayer color correction hydroquinone or an organic accelertor having an under-cut interimage effect.

The interlayer color correction couplers (ICC-coupler) used in the present invention designate those couplers as defined in U.S. patent application Ser. No. 467,539, filed May 6, 1974, that is, couplers which provide an interlayer effect and, consequently, have the function of color correction. Preferred couplers are those described in U.S. patent application Ser. No. 454,525, filed Mar. 25, 1974, which include the so-called DIR-couplers as a portion thereof. Particularly, they are couplers represented by the formula (IV):

$$Cp - Z \qquad (IV)$$

where, Cp represents a coupler residue which reacts with the oxidation products of primary aromatic amine color developing agents by a coupling reaction, and Z represents an organic residue which can be released by the coupling reaction with the oxidation products of primary aromatic amine color developing agents and has a property of inhibiting the development by diffusion after its release. Cp can be chosen from, for example, the residues of 4-equivalent couplers used for color photosensitive materials. Examples of such couplers include 5-pyrazolone couplers, cyanoacetylcoumarone couplers, imidazolone couplers, acylacetanilide couplers, pivaloylacetanilide couplers, aroylacetamide couplers, naphthol couplers and phenol couplers, etc. Z represents a heterocyclic residue having a 1-triazole ring or 1-diazole ring as described in U.S. patent application Ser. No. 454,525, filed on Mar. 25, 1974, a 2-benzotriazole residue as described in U.S. Pat. No. 3,617,291, an aryl monothio group, or a heterocyclic thio group wherein the heterocyclic rirng represents a tetrazole, triazinyl, triazolyl, oxazolyl, imidazolyl, oxadiazolyl, thiadiazolyl, benzothiazolyl, pyrimidyl or pyridinyl group, as described in, for example, U.S. Pat. Nos. 3,617,291, 3,622,328, 3,632,373, 3,620,745, 3,620,747 and 3,615,506, and British Patent No. 1,201,110 and U.S. Pat. No. 3,703,375. Particularly, residues represented by the formula (IVa) are preferred:

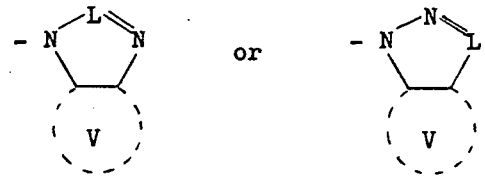

(IVa)

wherein, V represents a benzene bype aromatic ring or a heterocyclic aromatic ring containing at least one nitrogen atom, and L represents a methine group. V can be a substituted with one or more of an amino group, an acylamino group, a halogen atom such as chlorine, bromine, iodine and fluorine, and alkyl group, nitro group, an alkoxy group, an alkylthio group or aryl group, etc. wherein the acyl and alkyl moieties thereof contain 1 to 15 carbon atoms. ZH is described in, for example, U.S. Pat. Nos. 3,185,570, 3,244,521, 3,499,761, 3,473,924, 3,575,699 and 3,554,757, British Patent Nos. 919,061 and 1,031,262, French Patent Nos. 1,346,227 and 1,594,983 and German Patent No. 1,294,188.

The interlayer color correction (I.C.C.) hydroquinone derivatives used in the present invention designate compounds which release a diffusible development inhibitor with an image wise distribution on development during a color development step and inhibit selectively color development in the adjacent emulsion layer to, consequently exhibit an interlayer color correcting effect. Preferably, they are hydroquinone derivatives substituted with a heterocyclic monothio group which becomes a development inhibitor and an aliphatic thio or aliphatic oxy group having 8 or more carbon atoms which serves as an antidiffusion ballasting group or precursors of such hydroquinone derivatives. Preferred compounds are represented by the following formula (V)

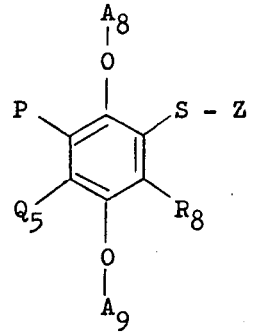

(V)

wherein, $A_8$ and $A_9$ each represents a hydrogen atom or a group which can be released by alkali (e.g., an alkoxycarbonyl group or an acyl group, etc.), wherein $A_9$ may form a ring by combining with $R_8$ or $Q_5$ (e.g., an oxathiazole ring, an oxazole ring, an oxadiazole ring, a furyl ring etc.). P, $Q_5$ and $R_8$ each represents a hydrogen atom, an alkyl group (e.g., having 1 to 18 carbon atoms such as methyl, ethyl, octyl, tridecyl and the like), an alkenyl group (e.g., having 2 to 18 carbon atoms such as allyl, octadecenyl and the like), a hydroxyl group, an alkoxy group (e.g., having 1 to 18 carbon atoms such as methoxy, ethoxy and the like), an amino group (e.g., an amino group or a substituted amino group having 1 to 30 total carbon atoms such as diethylamino, phenylamino, octadecylamino and the like), an alkylthio group (e.g., nonylthio, tridecylthio and the like), an aryl group (e.g., phenyl, tolyl, and the like), an arylthio group (e.g., phenylthio, tolylthio and the like), a halogen atom, a heterocyclic group (e.g., tetrazolyl, thiazolyl, quinonyl and the like) or a —SZ group (e.g., tetrazolylthio, thiadiazolylthio and the like), and P and Q can combine to form a carbocyclic ring group (e.g., a benzene ring group or a tetrahydrobenzene ring group). $A_8$ and $A_9$ each represents a hydrogen atom or alkaline splitable group selected from acyl groups and alkoxycarbonyl groups (e.g., having 1 to 8 carbon atoms such as acetyl, phenoxycarbonyl, methoxycarbonyl, etc.). Z represents a heterocyclic residue which is photographically inactive in a combined state and which can be released at development, and particularly a heterocyclic aromatic group such as a tetrazolyl group (e.g., 1-phenyltetrazolyl, 1-alkoxyphenyltetrazolyl and the like), a triazolyl group (e.g., 1-phenyl, 3-n-amyl, 1,2,4-triazolyl and the like), a thiadiazolyl group (e.g., 5-methylthio-thiadiazolyl, 5 propylthiadiazolyl and the like), an oxazolyl group (e.g., 4-methyloxazolyl, benzoxazolyl, β-naphthoxazolyl and the like), an oxadiazolyl group, a thiazolyl group or a pyrimidyl group.

It is possible to render these ICC-hydroquinone derivatives diffusion resistant by combining them with polymers by a ballasting group through P, $Q_5$ or $R_8$ or by a residue of P, $Q_5$ or $R_8$. For example, these ICC-hydroquinone derivatives (I) can be rendered diffusion resistant by P, $Q_5$ or $R_8$ containing a ballasting group, e.g., a hydrophobic group having 8 to 32 carbon atoms. It is also possible to render the hydroquinone derivatives (I) diffusion resistant by combining them with polymer residues through the P, $Q_5$ or $R_8$ group.

Suitable examples of such ballasting groups are described in detail hereinafter.

The organic accelerator having an interlayer undercut interimage effect used in the present invention designates an organic compound which is incorporated optionally in an certain photosensitive emulsion layer to enhance the uner-cut interimage effect to other adjacent photosenitive emulsion layers at development, which has been described in, for example, U.S. Defensive Publications Nos. T909,022 and T909,023 and U.S. Pat. Nos. 3,713,828 and 3,723,125. For example, such compounds are represented by the formula (VI)

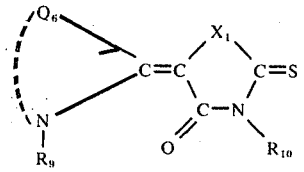

(VI)

wherein, $X_1$ represents a sulfur atom, an oxygen atom, a selenium atom or a =N—$R_{11}$ group wherein $R_{11}$ represents a hydrogen atom, an aliphatic group, an aryl group or a heterocyclic ring, and $R_9$ and $R_{10}$ each represents a hydrogen atom, an aliphatic group or an aryl group. $Q_6$ represents the non-metal atoms required to form a heterocyclic ring used generally as a nucleus of cyanine dyes; and the formula (VII)

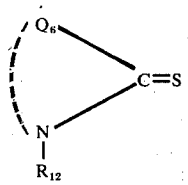

(VII)

In the formula $Q_6$ is as defined above and $R_{12}$ has the same meanings as $R_9$ of formula (VI).

Where the development inhibiting releasable group (Z in formula (IV)) of the interlayer color correction coupler is a mercapto residue, the interlayer color correction effect arises to a comparatively low degree while the development inhibiting effect in the layer occurs to a comparatively high degree, because the mercapto group is firmly adsorbed on the photosensitive silver halide by a chemical bond. On the contrary, where the development inhibiting releasable group is the group represented by the formula (IVa), the interlayer color correction effect arises to a comparatively high degree. In this case, the effect caused by providing the adsorbing colloid layer for the organic development inhibitor according to the present invention appears markedly.

The adsorbing colloid layer for the organic development inhibitor (ADL) of the present invention designates a colloid layer which has the function whereby the organic development inhibitor released from compounds such as an I.C.C. coupler or an I.C.C. hydroquinone or from an organic accelerator providing an under-cut interimage effect adsorbed previously on the silver halide particles by development of the particles is fixed by adsorption to prevent introduction thereof into the developer, a colloid layer having the function of removing the once released inhibitor in the developer by adsorption, or a colloid layer having the function of controlling the diffusion of the development inhibitor into each emulsion layer of the photosensitive material. This colloid layer contains a basic synthetic polymer having a repeating unit represented by the formula (I) or (II). It has been found that such synthetic polymers have the function of adsorbing effectively the organic development inhibitor. This is a surprising fact which was not known at all. The ADL of the present invention can contain silver halide particles, colloidal silver, colloidal gold or colloidal silica etc. in addition to the synthetic polymer so as to further enhance the adsorbability for the development inhibitor.

It is particularly advantageous for the ADL of the present invention to be used for multilayer color photographic materials containing color forming couplers. Namely, enhancing the under-cut interimage effect between emulsion layers is an important technique in order to improve color reproduction in the multilayer color photosensitive materials. Thus, I.C.C. couplers, I.C.C. hydrroquinones or organic accelerators having an under-cut interimage effect are used for such a purpose. In such multilayer color photosensitive materials, it is necessary to maintain a balance between each under-cut interimage effect and to prevent generation of "development mottle" caused by the development inhibitor over a too wide range in the planar direction of the photosensitive material, and thus the ADL is advantageously used. In this case, it is preferable that the ADL be provided between each emulsion layers. Futhermore, in this case, if acid dyes as described in U.S. patent application Ser. No. 501,107, filed Aug. 27, 1974* are added to the ADL to mordant a part of the basic synthetic polymer, it is advantageous for photographic properties and the cost of production, because the ADL serves as a color layer which provides the properties of antiirradiation, antihalation and a light filter, improvement of safe light stability and capability of controlling printing conditions of positive sensitive materials without increasing the number of layers. Further, in multilayer color photosenstive materials using I.C.C. hydroquninones or organic accelerators having an under-cut interimage effect, contamination of the developer caused by the released development inhibitor must be prevented. For this purpose, it is advantageous to provide the ADL above the emulsion layer in the direction of incident light on exposure or on the back of the support.

*(Japanese Patent Application No. 95965/73)

As the color couplers used in the above described multilayer color sensitive materials, 4-equivalent couplers or 2-equivalent couplers can be used with 2-equivalent couplers being preferred. Particularly, couplers represented by the formula (VIII), (IX), and (XI) are preferred.

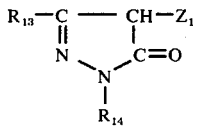

(VIII)

In the formula (VIII), $R_{13}$ represents an alkyl group selected from primary, secondary and tertiary alkyl groups (e.g., methyl propyl, n-butyl, tert-butyl, hexyl, 2-hydroxyethyl, 2-phenylethyl or pentadecyl, etc.), an aryl group (e.g., phenyl or 2,4-di-tert-phenyl, etc.), an alkoxy group (e.g., methoxy, ethoxy or benzyloxy, etc.), and aryloxy group (e.g., phenoxy, etc.), a heterocyclic residue (e.g., quinolinyl, pyridyl, benzofuranyl or oxazolyl, etc.), an amino group (e.g., methylamino, diethylamino, phenylamino, tolylamino, 4-(3-sulfobenzamino)-anilino, 2-chloro-5-acylamino-anilino, 2-chloro-5-alkoxycarbonyl-anilino, or 2-trifluoromethylphenylamino, etc.), an acylamino group (e.g., alkyl carbonamido such as ethyl carbonamide, aryl carbonamido, heterocyclic carbonamido such as benzothiazolyl carbonamido, sulfonamido, alkysulfonamido, arylsulfonamido or heterocyclic sulfonamido, etc.), or a ureido group (e.g., alkylureido, arylureido or heterocyclic ureido, etc. ). $R_{14}$ represents an aryl group (e.g., naphthyl, phenyl, 2,4,6-trichlorophenyl, 2-chloro-4,6-dimethylphenyl, 2,6-dichloro-4-methoxyphenyl, 4-methylphenyl, 4-acylaminophenyl, 4-alkylaminophenyl, 4-trifluoromethylphenyl, or 3,5-dibromophenyl, etc.), a heterocyclic group (e.g., benzofuranyl, benzothiazolyl or quinolinyl, etc.) or an alkyll group selected from primary, secondary and tertiary alkyl groups (e.g., methyl, ethyl or benzyl, etc.). $Z_1$ represents a hydrogen atom or a group which can be released at color development, for example, a thiocyano group, an acyloxy group, an aryloxy group, an alkoxy group, an alkoxycarbonyl group, an arylocycarbonyloxy group, an aryloxycarbonyloxy group, a di-substituted amino group, an aryl-azo group or a heterocyclic azo group, etc., which have been described in, for example, U.S. Pat. Nos. 3,419,391, 3,252,924, 3,311,476 and 3,227,550, and Japanese Patent Applications Nos. 41869/1973 and 56050/1973, etc.

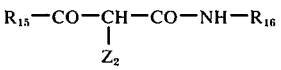

(IX)

In the formula, $R_{15}$ represents an alkyl group selected from primary, secondary and tertiary alkyl groups (e.g., tert-butyl, 1,1-dimethylpropyl, 1,1-dimethyl-1-methoxyphenoxymethyl, etc.), or an aryl group (e.g., phenyl, alkylphenyl such as 2-methylphenyl, 3-octadecylphenyl, etc., alkoxyphenyl such as 2-methoxyphenyl, 4-methoxyphenyl, etc., halophenyl, 2-chloro-5-alkylcarbamidophenyl, 2-chloro-5-[α-(2,4-ditert-aminophenoxy)-butyramido]phenyl, 2-methoxy-5-alkylamidophenyl or 2-chloro-5-sulfonamidophenyl, etc.), and $R_{16}$ represents a phenyl group (e.g., 2-chlorophenyl, 2-halo-5-alkylamidophenyl, 2-chloro-5-[α-2,4-di-tert-amylphenoxy)acetamido]-phenyl, 2-chloro-5-(4-methylphenylsulfonamido)phenyl or 2-methoxy-5-(2,4-di-tert-amylphenoxy)-acetamido phenyl, etc.). $Z_2$ represents a hydrogen atom or a group which can be released at color development, for example, a halogen atom and preferably a fluorine atom, an acyloxy group, an aryloxy group, a heteroaromatic carbonyloxy group, a sulfonimido group, an alkylsulfoxy group, an arylsulfoxy group, a phthalimido group, a dioxodimidazolidinyl group, a dioxooxazolidinyl group or a dioxomorpholino group, etc., which have been described in, for example, U.S. Pat. Nos. 3,227,550, 3,253,924, 3,227,155, 3,265,506, 3,408,194 and 3,415,652, French Patent No. 1,411,384, British Patents Nos. 944,490, 1,040,710 and 1,118,028, German Patent Publications (OLS) Nos. 2,057,941, 2,163,812, 2,213,461 and 2,219,917 and U.S. patent application Ser. No. 454,525, filed Mar. 25, 1974

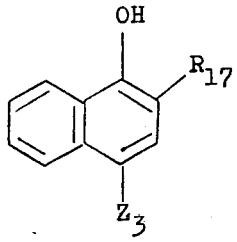

(X)

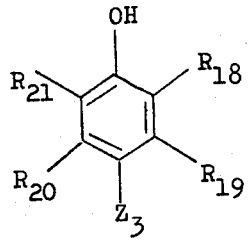

(XI)

In the formulae, (X) and (XI), $R_{17}$ represents a substituent used in cyan couplers, for example, a carbamoyl group (e.g., alkylcarbamoyl, arylcarbamoyl such as phenylcarbamoyl, or heterocyclic carbamoyl such as benzothiazolylcarbamoyl, etc.), a sulfamoyl group (e.g., alkylsulfamoyl, arylsulfamoyl such as phenylsulfamoyl or heterocyclic sulfamoyl, etc.), an aryloxycarbonyl group or an alkoxycarbonyl group. $R_{18}$ represents an alkyl group, an aryl group, a heterocyclic group, an amino group, a carbonamido group (e.g., alkylcarbamido or arylcarbamido, etc.), a sulfonamido group, a sulfamoyl group or a carbamoyl group. $R_{19}$, $R_{20}$ and $R_{21}$ each represents the same groups as defined for $R_{18}$, and additionally a halogen atom or an alkoxy group. $Z_3$ represents a hydrogen atom or a group which can be released at color development, for example, a halogen atom, a thiocyano group, a cycloimido group (e.g., maleimido, succinimido or 1,2-dicarboximido, etc.), an arylazo group or a heterocyclic azo group, etc.

In order to provide the couplers with diffusion resistance, a group containing a hydrophobic residue having 8 to about 32 carbon atoms is introduced into the molecule of the couplers. Such a residue is called a ballast group. The ballast group can be linked to skeleton of the couplers directly or through an imino bond, a ether bond, a carbonamido bond, a sulfonamido bond, a ureido bond, an ester bond, an imido bond, a carbamoyl bond or a sulfamoyl bond, etc.

Some ballast groups are described in the examples of couplers given hereinafter.

Specific examples of ballast groups include the following groups

I. Alkyl groups or alkenyl groups

For example, $CH_2—CH—(C_2H_5)_2$, $—C_{12}H_{25}$, $—C_{16}H_{33}$ and $—C_{17}H_{33}$.

II. Alkoxyalkyl groups

For example, $—(CH_2)_3—O—(CH_2)_7CH_3$ and $$—(CH_2)_3OCH_2—\underset{\underset{C_2H_5}{|}}{CH}—(CH_2)_8—CH_3$$

which have been described in Japanese Patent Publication No. 27563/1964.

III. Alkylaryl groups

For example,

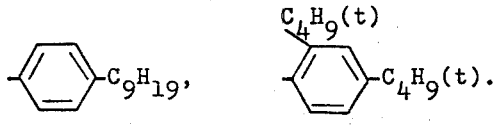

IV. Alkylaryloxyalkyl groups

For example,

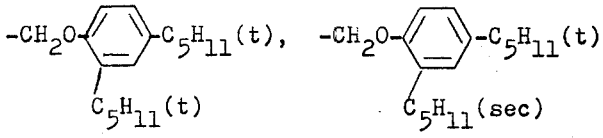

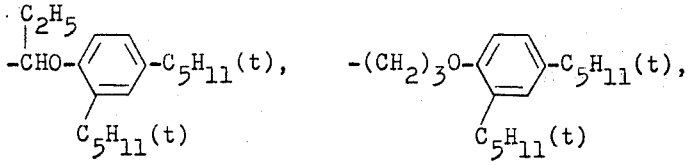

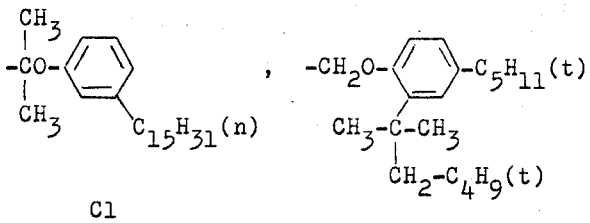

and

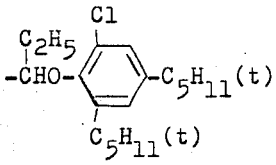

V. Acylamidoalkyl groups

For example, the groups described in U.S. Pat. Nos. 3,337,344 and 3,418,129.

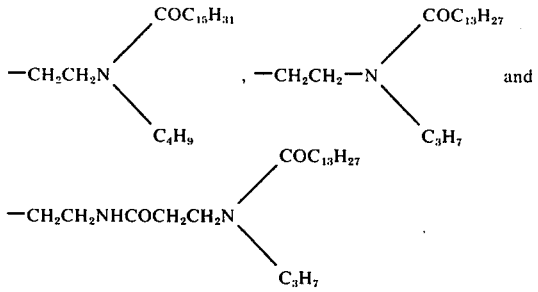

VI. Alkoxyaryl or aryloxyaryl groups

For example,

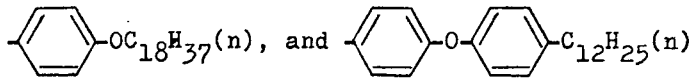

VII. Residues having an alkyl or alkenyl higher aliphatic group and a carboxyl or sulfo water-solubilizing group.

For example,

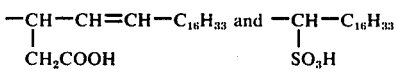

VIII. Alkyl groups substituted with an ester group

For example,

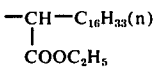

$-CH_2-CH_2-COOC_{12}H_{25}(n)$ and

IX. Alkyl groups substituted with an aryl group or a heterocyclic group

For example,

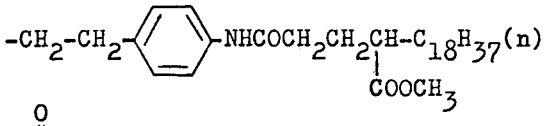

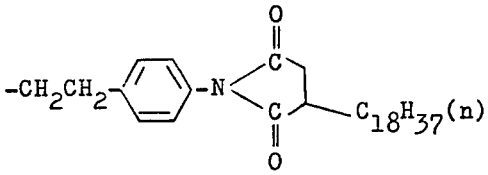

X. Aryl groups substituted with an aryloxyalkoxycarbonyl group

For example,

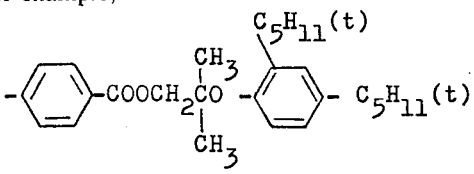

In the following, typical examples of materials used for multilayer color photosensitive materials of the present invention are described. However, the photosensitive materials of the present invention are not to be construed as being limited to these examples.

YELLOW COUPLERS

1. α-{3-[α-(2,4-Di-tert-amylphenoxy)butyramido]-benzoyl}-2-methoxyacetanilide
2. α-Acetoxy-α-3-[γ-(2,4-di-tert-amylphenoxy)-butyramido]benzoyl-2-methoxyacetanilide
3. N-(4-Anisoylacetamidobenzenesulfonyl)-N-benzyl-N-toluidine
4. α-(2,4-Dioxo-5,5-dimethyloxazolidinyl)-α-pivaloyl-2-chloro-5-[α-(2,4-ditert-amylphenoxy)-butyramido]acetanilide
5. α-(4-Carboxyphenoxy)-α-pivaloyl-2-chloro-5-[α-(2,4-di-tert-amylphenoxy)butyramido]acetanilide
6. α-[3-(1-Benzyl-2,4-dioxo)hydantoin]-α-pivaloyl-2-chloro-5-[α-(2,4-di-tert-amylphenoxy)-butyramido]acetanilide
7. α-(4-Methoxybenzoyl)-α-(3,5-dioxomorpholino)-5-[γ-(2,4-di-tert-amylphenoxy)butyramido]-2-chloroacetanilide

MAGENTA COUPLERS 8. 1-(2,4,6-Trichlorophenyl)-3-[3-(2,4-di-tert-amylphenoxy-acetamido)benzamido]-5-pyrazolone
9. 1-(2,4,6-Trichlorophenyl)-3-{3-[α-(2,4-di-tert-amylphenoxy)acetamido]benzamido}-4-acetoxy-5-pyrazolone
10. 1-(2,4,6-Trichlorophenyl)-3-tridecylamido-4-(4-hydroxyphenyl)azo-5-pyrazolone
11. 1-(2,4,6-Trichlorophenyl)-3-[(2-chloro-5-tridecanoylamino)anilino]-5-pyrazolone
12. 1-(2,4,6-Trichlorophenyl)-3-(2-chloro-5-tetradecyloxycarbonyl)anilino-4-(1-naphthylazo)-5-pyrazolone
13. 1-(2,4-Dichloro-6-methoxyphenyl)-3-[(2-chloro-5-tridecanoylamino)anilino]-4-benzyloxycarbonyloxy-5-pyrazolone
14. 1-(2,4,6-Trichlorophenyl)-3-{3-[(2,4-di-tert-amylphenoxy)acetamido]benzamido}-4-piperidino-5-pyrazolone
15. 1-(2,4,6-Trichlorophenyl)-3-{2-chloro-5-[α-(2,4-di-tert-amylphenoxy)butyramido]anilino}-4-N-phthalimido-5-pyrazolone
16. 1-(2,4,6-Trichlorophenyl)-3-(2-chloro-5-tetradecylamino-anilino)-4-(3-methyl-4-hydroxyphenylazo)-5-pyrazolone

CYAN COUPLERS 17. 1-Hydroxy-N-[γ-(2,4-di-tert-amylphenoxypropyl)]-2-naphthamide
18. 1-Hydroxy-4-[2-(2-hexyldecyloxycarbonyl)-phenylazo]-2-N-(1-naphthyl)-naphthamide
19. 1-Hydroxy-4-chloro-N-[α-(2,4-di-tert-amylphenoxy)butyl]-2-naphthamide.
20. 5-Methyl-4,6-dichloro-2-[α-(3-n-pentadecylphenoxy)butyramido]phenol
21. 1-Hydroxy-4-(2-ethyloxycarbonylphenylazo)-N-(2-ethylamyl)-2-naphthamide

INTERLAYER COLOR CORRECTION UNCOLORED COUPLERS

22. α-Benzoyl-α-(2-benzothiazolylthio)-4-[N-(γ-phenylpropyl)-N-(4-tolyl)sulfamoyl]acetanilide
23. 1,14-[γ-(2,4-di-tert-amylphenoxybutyramido)-phenyl]-3-piperidinyl-4-(1-phenyl-5-tetrazolylthio)-5-pyrazolone
24. 1-(2,4,6-Trichlorophenyl)-3-{4-[α-(2,4-di-tert-amylphenoxy)butyramido]anilino}-4-(1-phenyl-5-tetrazolylthio)-5-pyrazolone
25. 1-{4-[α-(2,4-di-tert-amylphenoxy)acetamido]-phenyl}-3-methyl-4-(5- or 6-bromo-1-benzotriazolyl)-5-pyrazolone
26. 5-Methoxy-2-[α-(3-n-pentadecylphenoxy)-butyramido]-4-(1-phenyl-5-tetrazolylthio)phenol
27. N-[α-(2,4-Di-tert-amylphenoxy)acetyl]-ω-(1-phenyl-5-tetrazolylthio)-m-acetophenone
28. α-Pivaloyl-α-(5- or 6-bromo-1-benzotriazolyl)-5-[α-(2,4-di-tert-amylphenoxy)propionamido]-2-chloroacetanilide
29. α-(4-Methoxybenzoyl)-α-(5- or 6-nitro-1-benzotriazolyl)-5-[γ-(2,4-di-tert-amylphenoxy)-butyramido]-2-chloroacetanilide
30. α-(4-Stearoyloxybenzoyl)-α-(5- or 6-bromo-1-benzotriazolyl)-2-methoxyacetanilide
31. 1-Hydroxy-4-(1-phenyltetrazolylthio)-N-[(2-chloro-5-hexadecyloxy)phenyl]-2-naphthamide

INTERLAYER COLOR CORRECTION HYDROQUINONES 32. 2-n-Dodecylthio-5-(1′-phenyl-5′-ylthio)hydroquinone
33. 2-n-Octadecylthio-5-(1′-phenyltetrazol-5-ylthio)hydroquinone
34. 2-n-Hexadecylthio-5-(1′-phenyltetrazol-5-ylthio)hydroquinone
35. 2-(1′-Phenyltetrazol-5′-ylthio)-3-phenylthio-6-(1″,1″,3″,3″-tetramethylbutyl)hydroquinone
36. 2-n-Hexadecylthio-5-(1′-phenyltetrazol-5′-ylthio)-6-phenylthiohydroquinone
37. 2-n-Octadecylthio-5-(1′-phenyltetrazol-5′-ylthio)-6-phenylthiohydroquinone
38. 2-n-Pentadecyl-5-(1′-phenyltetrazol-5′-ylthio)-hydroquinone
39. 2-[2′,5′-Dihydroxy-6′-(1″-phenyltetrazol-5″-ylthio)-3′-octadecyl]phenylthiobenzoic acid methyl ester
40. 2-[2′,5′-Dihydroxy-6′-(1″-phenyltetrazol-5″-ylthio)-3′-hexadecylthio]phenylthiobenzoic acid amyl ester
41. 2-′2′-Methylthio-1′,3′,4′-thiadiazol-5′-ylthio)-6-n-pentadecylhydroquinone
42. 2-(3′-n-Pentyl-4′-phenyl-1′,2′,4′-triazol-5′-ylthio)-5-hexadecylthiohydroquinone
43. 2-(6′-Methyl-1′,3′,3a′,7′-tetrazainden-4′-ylthio)-6-(1″,1″,3″,3″-tetramethylbutyl)hydroquinone Typical examples of organic accelerators having the undercut interimage effect which can be used in the present invention are described in the following. However, the invention is not to be construed as being limited to these examples.

44. 5-(3-Ethyl-2-benzoxazolylidene]-3-benzylrhodanine
45. 5-[3-(γ-sulfopropyl)-2-benzoxazolylidene]-3-cyclohexylrhodanine
46. 5-(3-Methyl-2-benzoselenazolylidene)-3-(γ-sulfobutyl)rhodanine
47. 5-[3-(β-hydroxyethyl)-β-naphthoxazolylidene]-1-phenyl-2-thiohydantoin
48. 2-Thioxo-3-ethylbenzothiazole
49. 2-Mercapto-5-methylbenzothiazole
50. 1-Thioxo-3-n-propylbenzoxazole
51. 1,3-Di-n-propyl-2-thioxobenzimidazole
52. N-Methyl-2-thioxo-6-chloroquinoline The couplers according to the present invention can be classified into Fischer type couplers having water soluble groups such as carboxyl, hydroxy and sulfo groups and hydrophobic couplers. Methods of adding the couplers to emulsions and dispersion therein and methods of adding them to gelatin silver halide emulsions or hydrophilic colloids which have been known hitherto can be employed. For example, a method of dispersing a coupler by mixing with an organic solvent having a high boiling point such as dibutyl phthalate or tricresyl phosphate, a fatty oil which is liquid at a normal temperature (e.g., 20° to 30°C), a wax, a higher fatty acid or ester thereof, a method described, for example, in U.S. Pat. Nos. 2,304,939 and 2,322,027, a method of dispersing a coupler by mixing the coupler with an organic solvent having a low boiling point or a water-soluble organic solvent, a method of dispersing a coupler using an organic solvent having a high boiling point together with the above described organic solvent having a low boiling point or a water soluble solvent, for example, the method described in U.S. Pat. Nos. 2,801,170, 2,801,171 and 2,949,360, and a method of dispersing a coupler having a low melting point (e.g. below 75°C) alone or together with another couplers, e.g., a colored coupler or an uncolored coupler, for example, the method described in German Pat. No. 1,143,707, can be used.

Dispersion assistants include anionic surface active agents (e.g., sodium alkylbenzene sulfonate, sodium dioctyl sulfosuccinate, sodium dodecyl sulfate, sodium alkylnaphthalene sulfonate and Fischer type couplers, etc.), amphoteric surface active agents (e.g., N-tetradecyl-N,N-di-polyethylene-α-betaine, etc.) and nonionic surface active agents (e.g., sorbitan-monolaurate, etc.) which are conventionally used.

The couplers are, generally, used in a weight ratio of about 1:100 to 1:2 to the silver halide. The interlayer color correction couplers can be used alone or as a mixture with other couplers, and they are used in the amount below about 50% by mol and preferably below 20% by mol based on the total amount of couplers used in the photosensitive material according to the present invention.

The interlayer color correction hydroquinone derivatives according to the present invention can be used by dispersing in the same manner as that of hydrophobic couplers. Preferably, they are used by mixing with a hydrophobic coupler or with a known hydroquinone derivative used hitherto. The I.C.C. hydroquinone derivatives are used in the amount of below about 20% by mol based on the total amount of the couplers used.

The organic accelerator having an under-cut interimage effect is added after dissolving in a water miscible organic solvent such as methanol, ethanol, pyridine, methyl cellosolve or acetone, or water. Usually, it is used in the amount of about $10^{-7}$ to $10^{-3}$ mols per mol of silver halide.

The silver halide emulsions used for photosensitive emulsion layers in the present invention are those wherein silver chloride, silver bromide or mixed silver halide such as silver chlorobromide, silver iodobromide or silver chloroiodobromide is finely dispersed in a hydrophilic high molecular weight material such as gelatin. The silver halide is chosen depending on the purpose of use of the photosensitive material from dispersions having a uniform grain size or those having a wide distribution of grain size or from dispersions having an average grain size of about 0.1 micron to about 3 microns. These silver halide emulsions can be prepared, for example, by a single jet method; by a double jet method or a control double jet method, or by a method of ripening such as an ammonia method, a neutral method or an acid, etc.

The silver halide emulsions used for the photosensitive emulsion layers in the present invention can be sensitized using conventional chemical sensitization methods. For example, a gold sensitization method described in U.S. Pat. Nos. 2,399,083, 2,597,856 and 2,597,915, a reduction sensitization method described in U.S. Pat. Nos. 2,587,850 and 2,521,925, a sulfur sensitization method described in U.S. Pat. Nos. 1,623,499 and 2,410,689, a method of sensitizing using metal ions other than silver described in U.S. Pat. Nos. 2,448,060, 2,566,245 and 2,566,263, or a combination of these methods can be employed.

Spectral sensitization methods used conventionally for color photosensitive materials can also be employed such as those described in U.S. Pat. Nos. 2,519,001, 2,666,767, 2,734,900, 2,739,964 and 3,481,742. In addition, commonly used stabilizers such as 4-hydroxy-1,3,3a,7-tetrazaindene derivatives, antifogging agents such as mercapto compounds or benzotriazole derivatives, coating assistants, hardening agents, wetting agents or sensitizing agents, for example, onium derivatives such as quaternary ammonium salts described in U.S. Pat. Nos. 2,271,623 2,288,226 and 2,334,864 or polyalkylene oxide derivatives described in U.S. Pat. Nos. 2,708,162, 2,531,832, 2,533,990, 3,210,191 and 3,158,484 can be added. Further, dyes for preventing irradiation can be added. Furthermore, a filter layer, a mordanted color layer or a hydrophobic dye containing color layer can be included as a layer element of the color photosensitive materials of the present invention.

The photosensitive emulsions used in the present invention can be applied to any kind of conventional support. For example, a cellulose acetate film, a polyethylene terephthalate film, a polyethylene film, a polypropylene film, a glass plate, baryta paper, resin laminated paper and synthetic paper can be used as the support. A suitable amount of the silver halide coated on the support is about 0.01 to about 50 g (as silver) /m².

The photographic sensitive materials of the present invention are developed using color developers containing p-phenylenediamine derivatives or p-aminophenol derivatives as developing agents. Preferred examples of p-aminophenol derivatives include p-amino-N-ethyl-N-β-(methanesulfonamidoethyl)-m-toluidine sesquisulfate monohydrate, diethylamino-p-phenylenediamine sesquisulfite, p-amino-N,N-diethyl-m-toluidine hydrochloride and p-amino-N-ethyl-N-β-hydroxyethylaniline sesquisulfate monohydrate, etc. Furthermore, known developers for color negative sensitive materials, color negative or positive sensitive materials for cinema use, color papers or instant color sensitive materials can be used. For example, the color development processing described in Japanese Patent Publications No. 35749/1970, Japanese Patent Applications Nos. 67798/1969, 13313/1971 and 19516/1971, H. Gordon, *The British Journal of Photography* page 558 et seq, Nov. 15, 1954, ibid, page 440 et seq, Sept. 9, 1955 and ibid page 2 et seq, Jan. 6, 1956, S. Horwitz, ibid, page 212 et seq. Apr. 22, 1960, E. Gehret, ibid, page 396 et seq, May 7, 1965, J. Meech, ibid, page 182 et seq, Apr. 3, 1959, and West Germany Patent Publication (OLS) No. 2,238,051 can be used.

The following examples are given to illustrate the invention in greater detail. The present invention is not to be construed as being limited to these examples. Unless otherwise indicated, all parts percents, ratios and the like are by weight.

EXAMPLE 1

Sample A was produced by applying in turn a first layer, a second layer, a third layer, a fourth layer and a fifth layer to a transparent cellulose triacetate film support as shown in FIG. 1. The compositions and the properties of coating solutions used in each layer were as follows.

First Layer (BL)

To 1 kg of a silver iodobromide emulsion (silver content: 0.52 mols, iodide content: 6% by mol), 600 g of Emulsion I which was produced by dissolving 100 g of Coupler (4) in 100 ml of dibutyl phthalate and 200 ml of ethyl acetate and emulsifying the resulting solution in 1 kg of a 10% gelatin aqueous solution using 4 g of sodium dodecylbenzene sulfonate was added. The mixture was applied to form a first layer. The coated amount of silver in the first layer was 0.6 g/m².

Second Layer (GL)

1 kg of a silver iodobromide emulsion prepared (silver content: 0.6 mols, iodide content: 6% by mol) was spectrally sensitized using $2 \times 10^{-4}$ mols of Sensitizing Dye I and $6 \times 10^{-5}$ mols of Sensitizing Dye II. To this emulsion, 600 g of Emulsion II which was produced by dissolving 60 g of Coupler (8) and 40 g of Coupler (25) in 100 ml of tricresyl phosphate and 200 ml of ethyl acetate and emulsifying the resulting solution in 1 kg of a 10% gelatin aqueous solution using 4 g of sodium dodecylbenzene sulfonate was added. The coated silver amount of the second layer was 0.9 g/m².

Third Layer (ADL)

500 g of a 5% aqueous solution of a basic polymer comprising the repeating unit (P) was added to 1 kg of a 10% aqueous gelatin solution and the mixture was applied so as to have a dry film thickness of 3 μ.

Fourth Layer (RL)

1 kg of a silver iodobromide emulsion (same as in the first layer) was spectrally sensitized with $4 \times 10^{-5}$ mols of Sensitizing Dye III and $1 \times 10^{-5}$ mols of Sensitizing Dye IV. To this solution, 450 g of Emulsion III which was prepared using 100 g of Coupler (17) in the same manner as in Emulsion II was added. The silver content of the fourth layer was 1.7 g/m².

Fifth Layer (PL): Gelatin Protective Layer

A gelatin layer coated in an amount of 2 g of gelatin/m² to each coating solution, sodium polyvinylbenzene sulfonate as a viscosity increasing agent, sodium dodecylbenzene sulfonate as a surface active agent and a sodium salt of 2,6-dichloro-4-hydroxy-s-triazine as a gelatin hardening agent were added in suitable amounts to the above described compositions.

Materials used for producing Sample A:

Sensitizing Dye I: Anhydro-9'-ethyl-5,5'-dichloro-3,3'-disulfopropyloxacarbocyanine sodium salt.

Sensitizing Dye II: Anhydro-5,6,5',6'-tetrachloro-1,1'-diethyl-3,3'-disulfopropoxyethoxyethylimidazolocarbocyanine hydroxide sodium salt.

Sensitizing Dye III: Anhydro-5,5'-dichloro-3,3'-disulfopropyl-9-ethylthiacarbocyanine hydroxide pyridinium salt.

Sensitizing Dye IV: Anhydro-9-ethyl-3,3'-di(3-sulfopropyl)-4,5,4',5'-dibenzothiacarbocyanine hydroxide triethyl amine salt.

Sample B was produced in the same manner as Sample A but the third layer was a gelatin layer having the same thickness and did not contain the basic polymer containing repeating unit (P).

After exposure stepwise of Samples A and B to light from a green light source were exposed uniformly to light from a red light source. Then Sample A and B were processed using the following Development Process (1) at 38°C.

| | |
|---|---|
| 1. Color Development | 3 minutes and 15 seconds |
| 2. Bleaching | 6 minutes and 30 seconds |
| 3. Water Wash | 3 minutes and 15 seconds |
| 4. Fix | 6 minutes and 30 seconds |
| 5. Water Wash | 3 minutes and 15 seconds |
| 6. Stabilization | 3 minutes and 15 seconds |

The compositions of the processing solutions used in each step were as follows.

| | | |
|---|---|---|
| Color Developer: | | |
| Sodium Nitrilotriacetate | 1.0 | g |
| Sodium Sulfite | 4.0 | g |
| Sodium Carbonate | 30.0 | g |
| Potassium Bromide | 1.4 | g |
| Hydroxylamine Sulfate | 2.4 | g |
| 4-(N-Ethyl-N-β-hydroxyethylamino)-2-methyl-anilino Sulfate | 4.5 | g |
| Water to make | 1 | liter |
| Bleaching Solution | | |
| Ammonium Bromide | 160.0 | g |
| Aqueous Ammonia Solution (28%) | 25.0 | ml |
| Ethylenediamine-tetraacetic Acid Sodium Iron Salt | 130 | g |
| Glacial Acetic Acid | 14 | ml |
| Water to make | 1 | liter |
| Fixing Solution: | | |
| Sodium Tetrapolyphosphate | 2.0 | g |
| Sodium Sulfite | 4.0 | g |
| Ammonium Thiosulfate (70%) | 175.0 | ml |
| Sodium Bisulfite | 4.6 | g |
| Water to make | 1 | liter |
| Stabilizing Solution: | | |
| Formalin (40%) | 8.0 | ml |
| Water to make | 1 | liter |

Figure 4:
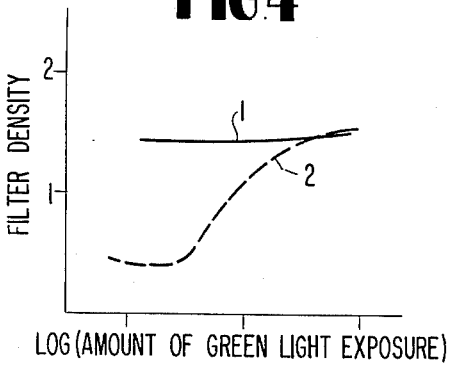
FIGS. 4 and 5 each shows characteristic curves obtained in the Example.
Figure 5:
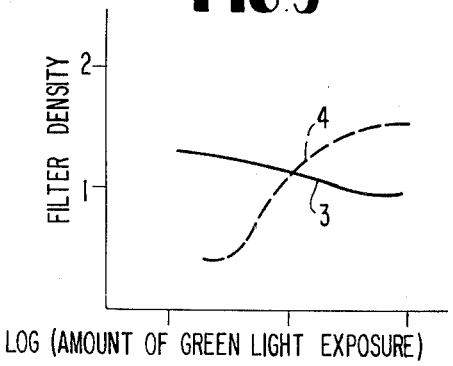

The red transmission densities (Curves 1 and 3) and the green transmission densities (Curve 2 and 4) of the processed Samples A and B were determined for comparison. The results of determination of Sample A are shown in FIG. 4 and that of Sample B are shown in FIG. 5. In Sample B, the green density increased as the exposure increased while the red density decreased. On the contrary, in Sample A having the ADL of the present invention, although the green density was the same as that of Sample B, no decrease of the red density was observed. It can be understood from these results that 5-benzotriazole formed by color development from Coupler (25) in the second layer of Sample B diffuses into the fourth layer to inhibit the development of the fourth layer, while the 5-bromobenzotriazole was adsorbed by the third layer (ADL) in Sample A and diffusion into the fourth layer was substantially prevented, namely the purpose of the present invention has been attained by the third layer.

On the other hand, Samples A and B were exposed uniformly to the same conditions as described above using light from a red light source, and then they were subjected to a line exposure of a width of 500 microns and a length of 10 millimeters using light from a green light source. They were then developed under the following Conditions (a), (b) and (c).

| | |
|---|---|
| Condition (a) | 15 minutes at 24°C |
| Condition (b) | 7 minutes at 30°C |
| Condition (c) | 4 minutes at 38°C |

In Sample B, violet-magneta development mottle was generated around the blue image on the strips developed in Conditions (b) and (c). However, no development mottle was generated in any of the conditions (a), (b) and (c) in Sample A.

EXAMPLE 2 the Example Shows the Effect of the ADL)

Figure 2:
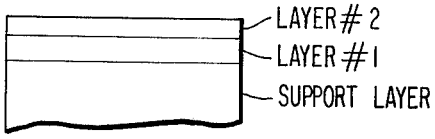

Sample C was produced by applying a first layer and a second layer to a transparent cellulose triacetate support as shown in FIG. 2. The compositions of each layer were as follows.

First Layer (RL)

Same as the fourth layer of Sample A and Sample B in Example 1.

Second Layer (ADL)

1 kg of a 5% aqueous solution of a basic polymer comprising the repeating unit (C) was added to 1 kg of a 10% aqueous gelatin solution and the mixture was applied in a dry thickness of 3 μ.

Samples D and E were produced in the same manner as Sample C but the basic polymer comprising repeating unit (C) in the second layer of Sample C was replaced by polymers comprising the repeating units (D) and (P), respectively.

Sample F was produced in the same manner as Sample C but the second layer was a gelatin layer only having the same thickness.

The Samples C to F were exposed stepwise to light and processed according to Developing Processing (1) in the same manner as in Example 1. Further, Developing Processing (2) which was the same as Developing Processing (1) was carried out but 0.023 g of 5-bromobenzotriazole was added to 1 liter of the color developer in Developing Processing (1). Furthermore, Developing Processing (3) which was the same as Developing Processing (1) was carried out but 0.035 g of 1-phenylmercaptotetrazole was added to 1 liter of the developer.

In Sample F, a remarkable decrease of densities was observed with Developing Processings (2) and (3) as compared with Developing Processing (1). On the contrary, in Samples C to E, any decrease of densities was hardly observed. It can be understood from these results that 5-bromobenzotriazole or 1-phenylmercaptotetrazole in the color developer in Sample F diffuses into the first layer in Developing Processing (2) or (3) to prevent development, while 5-bromobenzotriazole or 1-phenylmercaptotetrazole in Sample C is adsorbed by the second layer (ADL) to inhibit diffusion into the first layer and thus the purpose of the present invention are attained by the second layer. Namely, it can be understood that samples having an ADL are not affected by any contamination of the developer even if the developer which was contaminated by released development inhibitor is used.

EXAMPLE 3

Figure 3:
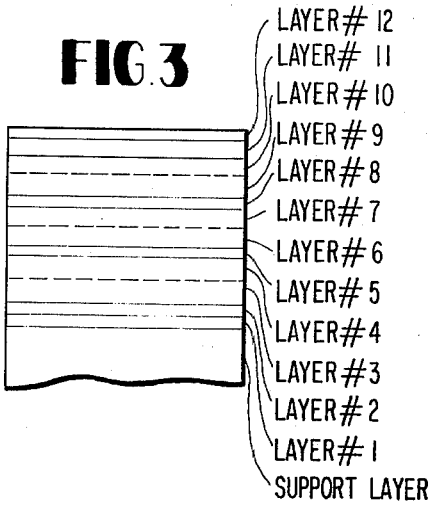

Multilayer color photosensitive Material G which comprises layers having the following compositions on a cellulose triacetate support was produced as shown in FIG. 3.

First Layer: Anthalation Layer (AHL)

Gelatin layer of a thickness of 1 $\mu$ which contained black colloidal silver at a coverage of 0.45 g/m$^2$.

Second Layer: Middle Layer (ML)

Gelatin layer containing a 2,5-di-t-octylhydroquinone emulsified dispersion in a thickness of about 1 $\mu$ and a coverage of 0.05 g of 2,5-di-t-octylhydroquinone/m$^2$.

Third Layer: First Red-Sensitive Emulsion Layer ($RL_1$)

Silver Iodobromide Emulsion (iodide: 8% by mol) — coated silver amount: 1.2 g/m$^2$
Sensitizing Dye I (that shown in Example 1) — 6 × $10^{-5}$ mols per mol of silver
Sensitizing Dye II (that shown in Example 1) — 1.5 × $10^{-5}$ mols per mol of silver
Coupler (17) — 0.09 mols per mol of silver
Coupler (18) — 0.02 mols per mol of silver

Fourth Layer: Second Red-Sensitive Emulsion Layer ($RL_2$)

Silver iodobromide emulsion layer (iodide content: 8% by mol) — coated silver amount: 1.1 g/m$^2$

| | |
|---|---|
| Sensitizing Dye I | 3 × $10^{-5}$ mols per mol of silver |
| Sensitizing Dye II | 1.2 × $10^{-5}$ mols per mol of silver |
| Couper (30) | 0.02 mols per mol of silver |
| Coupler (18) | 0.06 mols per mol of silver |
| Coupler (17) | 0.08 mols per mol of silver |

Fifth layer: Middle Layer (ML)

Same as the second layer.

Sixth Layer: First Green-Sensitive Emulsion Layer ($GL_1$)

Silver iodobromide emulsion layer (iodide content: 8% by mol) — coated silver amount: 1.4 g/m$^2$
Sensitizing Dye III (that shown in Example 1) — 3 × $10^{-5}$ mols per mol of silver
Sensitizing Dye IV (that shown in Example 1) — 1 × $10^{-5}$ mols per mol of silver

| | |
|---|---|
| Coupler (8) | 0.05 mols per mol of silver |
| Coupler (30) | 0.002 mols per mol of silver |
| Coupler (31) | 0.001 mols per mol of silver |

Seventh Layer: Second Green-Sensitive Emulsion Layer ($GL_2$)

Silver Iodobromide Emulsion Layer (iodide content: 6% by mol) — coated silver content: 1.5 g/m$^2$

| | |
|---|---|
| Sensitizing Dye III | 2.5 × $10^{-5}$ mols per mol of silver |
| Sensitizing Dye IV | 0.8 × $10^{-5}$ mols per mol of silver |
| Coupler (8) | 0.004 mols per mol of silver |
| Coupler (16) | 0.002 mols per mol of silver |
| Coupler (31) | 0.003 mols per mol of silver |

Eighth Layer: (YFL)

Gelatin layer in a thickness of about 1 $\mu$ which contained yellow colloidal silver (0.1 g/m$^2$) and a 2,5-di-t-octylhydroquinone (0.1 g/m$^2$) emulsfied dispersion in an aqueous gelatin solution.

Ninth Layer: First Blue-Sensitive Emulsion Layer ($BL_1$)

Silver Iodobromide Emulsion (iodide content: 6% by mol) — coated silver amount:

| | |
|---|---|
| Coupler (4) | 0.25 mols per mol of silver |
| Hydroquinone (33) | 0.01 mols per mol of silver |

Tenth Layer: Second Blue-Sensitive Emulsion Layer ($BL_2$)

Silver Iodobromide Emulsion Layer (iodide content: 6% by mol) — coated silver amount: 1.1 g/m$^2$

| | |
|---|---|
| Couper (4) | 0.06 mols per mol of silver |
| Hydroquinone (33) | 0.002 mols per mol of silver |

Eleventh Layer: ADL

Same as the second layer of Sample C in Example 2.

Twelfth Layer: Protective Layer (PL)

Gelatin layer in a thickness of about 1 $\mu$ containing polymethyl methacrylate particles (diameter: about 1.5 $\mu$; coverage 0.1 g/m$^2$).

A gelatin hardening agent (2,6-dichloro-4-hydroxy-s-triazine sodium salt), a surface active agent (sodium p-nonylbenzenesulfonate) and a viscosity increasing agent (polyvinylpyrrolidone) were added to each layer in suitable amounts.

Sample H was produced in the same manner as Sample G but eleventh layer of Sample H was a gelatin layer which did not contain the basic polymer.

Sample G and H were cut in to a width of 35 mm and uniformly exposed to white light. Then they were processed by Developing Processing (1). In Sample H, the red density, the green density and the blue density remarkably decreased as the amount of the film sample processed increased. On the contrary, in Sample G having the ADL of the present invention, the decrease in the densities was very small. Accordingly, it can be understood that the purpose of the present invention has been attained.

EXAMPLE 4

Sample I was produced in the same manner as Sample G but the fifth layer and the eleventh layer of Sample G were as follows:

Fifth Layer: (ADL)

100 g of a 5% aqueous solution of a basic polymer comprising the repeating unit (F) was mixed with 100 g of a 10% aqueous gelatin solution. Then, 10 g of a 10% aqueous solution of the acid dye; 4,4'-(1-propen-1-yl-3-ylidene)bis-(1-phenyl-3-ethoxycarbonylpyrazolin-5-one) was added thereto and the mixture was applied in a dry film thickness of 3 $\mu$.

Eleventh Layer: (ADL)

A mixture of 1 kg of a 5% aqueous solution of a basic polymer comprising the repeating unit (F) and 1 kg of a fine grain silver iodobromide emulsion (silver content: 0.5 mols, iodide content: 2% by mol, average particle size: 0.05 $\mu$) was applied in a dry film thickness of 3 $\mu$.

Sample I was processed to produce a 35 mm negative sensitive film and developed by Developing Processing (1). Thus a color negative material having very excellent color reproduction and sharpness was obtained.

When Sample I was processed in the same manner as in Example 3, deterioration of densities was not observed even if the amount of film processed increased.

EXAMPLE 5

Sample J was produced by providing the same ADL as that of the second layer of Sample C as in Example 2 on the back of the cellulose triacetate film support of Sample H produced as in Example 3. This example was cut in a width of 35 mm, exposed uniformly to white light and processed by Developing Processing (1) in the same manner as in Example 3. As the amount of film processed increased, the color densities decreased. However, the decrease of the color densities in Sample J was less than that of Sample F.

EXAMPLE 6

Sample H was produced by applying an ADL, BL, GL, RL and PL in turn to a cellulose triacetate film support using the same coating solutions as in Sample A of Example 1. After exposure uniformly to light from a red light source, Sample H was subjected to line exposure using light from a green light source. Development mottle of Sample H caused by development in the above described Condition (c) was remarkably less than that of Sample B.

EXAMPLE 7

In Example 2, Organic Accelerator (48) or (49) having an under-cut interimage effect was added to the developer in an amount of $1 \times 10^{-4}$ mols per liter of the developer, and Samples C and D were developed in the same manner as in Example 2. In Sample C having the ADL, the color densities hardly decreased. On the contrary, in Sample D, the color densities decreased and proceeding of the development was inhibited.

This fact shows that no disadvantage at development occurs if photosensitive materials having the ADL of the present invention are used even if the developer is contaminated with organic accelerators.

EXAMPLE 8

Sample K was produced by applying the following first layer and second layer to a transparent cellulose triacetate film support as shown in FIG. 2.

First Layer (Emulsion Layer)

To 1 kg of a silver chlorobromide emulsion (silver content: 0.6 mols; bromide content: 40 mol%), an emulsion which was produced by dissolving 30 g of hydroquinone in 60 ml of ethyl acetate and 60 ml of dibutyl phthalate and emulsifying the resulting solution in 60 g of a 10% aqueous gelatin solution was added. The mixture was applied to provide a silver content of 3 g per $m^2$.

Second Layer (ADL)

Same as the second layer in Sample C.

Sample L was produced in the same manner as in Sample M but the second layer was a gelatin layer.

Samples K and L were cut to produce strips of a width of 35 mm a length of 120 mm, exposed stepwise to light, developed at 20°C for 5 minutes and fixed to obtain black-white images. The compositions of the developer and the fixing solution were as follows.

| | | |
|---|---|---|
| Developer: | | |
| N-Methyl-p-aminophenol Sulfate | 2.5 | g |
| Sodium Sulfite | 30 | g |
| Hydroquinone | 2.5 | g |
| Sodium Metaborate | 10 | g |
| Potassium Bromide | 0.5 | g |
| Water to make | 1 | liter |
| Fixing Solution: | | |
| Sodium Thiosulfate | 250 | g |
| Sodium Sulfite | 20 | g |
| Glacial Acetic Acid | 20 | cc |
| Boric Acid | 8 | g |
| Potassium Alum | 20 | g |
| Water to make | 1 | liter |

When 1000 strips each of Samples K and L were treated, the sensitivity and contrast in Sample L decreased as the number of treated strips increased. However, in Sample K, the decrease of the sensitivity and the contrast were very small.

While the invention has been described in detail and with reference to specific embodiments thereof, it will be apparent to one skilled in the art that various changes and modifications can be made therein without departing from the spirit and scope thereof.

What is claimed is:

1. A photographic photosensitive material comprising a support having thereon at least one photosensitive silver halide emulsion layer, at least one photosensitive silver halide emulsion layer containing a compound which releases an organic development inhibitor on development, and a colloid layer containing a basic synthetic polymer containing therein the repeating unit represented by the formula (I)

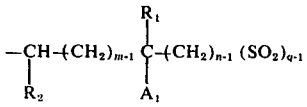

(I)

wherein $R_1$ represents a hydrogen atom or an alkyl group having 1 to 6 carbon atoms; $R_2$ represents a hydrogen atom, an alkyl group having 1 to 6 carbon atoms or an aryl group; *m* is 1 or 2; *n* is 1 or 2; *q* is 1 or 2; and $A_1$ represents a group containing a nitrogen atom which forms a secondary amino group, a tertiary amino group or a quaternary ammonium group, and $A_1$ may combine with $R_2$; or the formula (II)

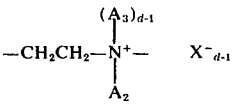

(II)

wherein $A_2$ represents a hydrogen atom or a substituted or unsubstituted alkyl group; $A_3$ represents a hydrogen atom or a substituted or unsubstituted alkyl group; X represents an anion; and *d* is 1 or 2, said photographic photosensitive material providing a negative image upon exposure to an original and subsequent development.

2. The photographic photosensitive material of claim 1, wherein said compound which releases an organic development inhibitor on development is a coupler which couples with an aromatic primary amine developing agent and releases said organic development inhibitor on coupling.

3. The photographic photosensitive material of claim 1, wherein said compound which releases an organic development inhibitor on development is a hydroquinone which releases said organic development inhibitor by oxidation.

4. The photographic photosensitive material of claim 1, wherein said compound which releases an organic development inhibitor on development is a color correction coupler, a color correction hydroquinone or an organic accelerator having an undercut interimage effect.

5. The photographic photosensitive material of claim 4, wherein said compound which releases an organic development inhibitor on development is a color correction coupler represented by the formula (IV)

Cp — Z (IV)

wherein Cp represents a coupler residue which reacts with the oxidation product of a primary aromatic amine color developing agent and Z represents an organic residue releasable on coupling with the oxidation product of a primary aromatic amine color developing agent and has the property of inhibiting the development by diffusion after release.

6. The photographic photosensitive material of claim 4, wherein said compound which releases an organic development inhibitor on development is a color correction hydroquinone having the formula (V)

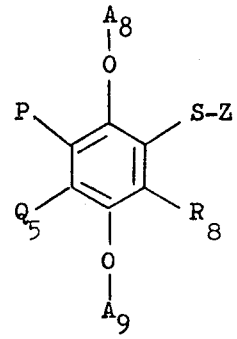

wherein $A_8$ and $A_9$ each represents a hydrogen atom or a group removable by alkali, wherein $A_9$ can form a ring by combining with $R_8$ or $Q_5$; P, $Q_5$ and $R_8$ each represents a hydrogen atom, an alkyl group, an aryl group, a —S—Y residue, a hydroxyl group, a halogen atom, a —S—Z residue, an alkoxy group, an aryloxy group, or a heterocyclic group; Y represents an alkyl group or an aryl group; and Z represents a heterocyclic residue which is substantially photographically inert in a bonded state.

7. The photographic photosensitive material of claim 4, wherein said compound which releases an organic development inhibitor on development is an organic accelerator having an under-cut interimage effect and is represented by the formula (VI)

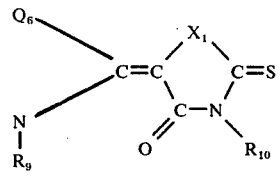

(VI)

wherein $X_1$ represents a sulfur atom, an oxygen atom, a selenium atom or a =N—$R_{11}$ group, wherein $R_{11}$ represents a hydrogen atom, an aliphatic group, an aryl group or a heterocyclic ring; $R_9$ and $R_{10}$ each represents a hydrogen atom, an aliphatic group or an aryl group; and $Q_6$ represents the non-metal atoms required to form a heterocyclic ring; or the formula (VII)

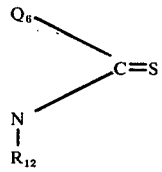

(VII)

wherein $Q_6$ is as defined above and $R_{12}$ has the same meaning as $R_9$.

8. The photographic photosensitive material of claim 1, wherein said compound which releases an organic development inhibitor on development comprises a couples which couplers with an aromatic primary amine developing agent to release said organic development inhibitor and a hydroquinone which releases said organic development inhibitor by oxidation.

9. The photographic photosensitive material of claim 1, wherein said compound which releases an organic development inhibitor on development comprises (1) a color correction coupler and a color correction hydroquinone or (2) a color correction coupler and an organic accelerator having an under-cut interimage effect.

10. The photographic photosensitive material of claim 1, wherein said support has thereon a red-sensitive emulsion layer, a green-sensitive emulsion layer and a blue-sensitive emulsion layer and said colloidal layer containing said basic synthetic polymer is positioned above each of said emulsion layers in the direction of incident light of exposure.

11. The photographic photosensitive material of claim 4, wherein said support has thereon a red-sensitive emulsion layer, a green-sensitive emulsion layer, and a blue-sensitive emulsion layer, said photosensitive material includes a yellow colloidal layer or a filter layer and said colloidal layer containing said basic synthetic polymer is adjacent said yellow colloidal layer or said filter layer.

12. The photographic photosensitive material of claim 4, wherein said support has thereon a red-sensitive emulsion layer, a green-sensitive emulsion layer and a blue-sensitive emulsion layer and wherein said colloid layer containing said basic synthetic polymer is below each of said layers in the direction of incident light upon exposure.

13. The photographic photosensitive material of claim 4, wherein said support has thereon a red-sensitive emulsion layer, a green-sensitive emulsion layer and a blue-sensitive emulsion layer, said photosensitive material includes an antihalation layer and said colloid layer containing said basic synthetic polymer is adjacent said antihalation layer.

14. The photographic photosensitive material of claim 4, wherein said support has thereon a red-sensitive emulsion layer, a green-sensitive emulsion layer and a blue-sensitive emulsion layer and said colloid layer containing said basic synthetic polymer is adjacent said emulsion layer containing said color correction coupler, said color correction hydroquinone or said organic accelerator having an under-cut interimage effect.

15. The photographic photosensitive material of claim 13, wherein said colloid layer containing said basic synthetic polymer contains an acid dye.

16. The photographic photosensitive material of claim 1, wherein said colloid layer containing said basic synthetic polymer is a protective layer.

17. The photographic photosensitive material of claim 15, wherein said colloid layer containing said basic synthetic polymer contains a polymer latex or colloidal silica.

18. The photographic photosensitive material of claim 1, wherein said colloidal layer containing said basic synthetic polymer contains very fine silver halide grains having an average grain size below about 0.2 microns.

19. The photographic photosensitive material of claim 1, wherein said material consists essentially of said support having thereon at least one photosensitive silver halide emulsion layer, with at least one photosensitive silver halide emulsion layer containing a compound which releases an organic development inhibitor on development, and said colloid layer containing said basic synthetic polymer represented by the formula (I) or the formula (II).

20. The photographic photosensitive material of claim 1, wherein said colloid layer functions as an adsorbing colloid layer for an organic development inhibitor.

* * * * *